US005769160A

United States Patent [19]

Owens

[11] Patent Number: 5,769,160

[45] Date of Patent: Jun. 23, 1998

[54] MULTI-FUNCTIONAL DOWNHOLE CABLE SYSTEM

[75] Inventor: Steve Owens, The Woodlands, Tex.

[73] Assignee: PES, Inc., The Woodlands, Tex.

[21] Appl. No.: 782,369

[22] Filed: Jan. 13, 1997

[51] Int. Cl.[6] ..... E21B 17/00

[52] U.S. Cl. ..... 166/65.1; 166/385

[58] Field of Search ..... 166/65.1, 384, 166/385, 250.01, 72

[56] References Cited

U.S. PATENT DOCUMENTS

| | | | |
|---|---|---|---|
| 4,248,298 | 2/1981 | Lamers et al. | 166/57 |
| 4,619,323 | 10/1986 | Gidley | 166/65.1 X |
| 5,080,175 | 1/1992 | Williams | 166/65.1 X |
| 5,172,765 | 12/1992 | Sas-Jaworsky et al. | 166/65.1 X |
| 5,234,058 | 8/1993 | Sas-Jaworsky et al. | 166/65.1 X |
| 5,269,377 | 12/1993 | Martin | 166/65.1 X |
| 5,285,008 | 2/1994 | Sas-Jaworsky et al. | 174/47 |
| 5,348,084 | 9/1994 | Fay et al. | 166/65.1 |

*Primary Examiner*—Frank Tsay

[57] ABSTRACT

An apparatus and method for communicating electricity from a well surface to a downhole well tool. An electrical conductor is positioned within a sheath, and fluid is placed within a passage extending through the sheath. Electricity is transmitted to the well tool through the conductor, and the fluid prevents well fluid intrusion into the sheath interior. The fluid can be pressurized from the well surface to communicate hydraulic fluid pressure to the well tool and to provide structural rigidity to the cable system. A diverter between the sheath and the well tool can selectively direct electricity or hydraulic fluid pressure to selected portions of the well tool, or to other tools positioned in the well.

20 Claims, 2 Drawing Sheets

MULTI-FUNCTIONAL DOWNHOLE CABLE SYSTEM

BACKGROUND OF THE INVENTION

The present invention relates to transmission lines and methods for communicating control signals and power downhole to a well tool. More particularly, the present invention relates to an apparatus and method for insulating an electricity carrying conductor and for transmitting electricity and hydraulic power to a downhole well tool through a single cable.

Well tools are placed downhole in well boreholes to perform different operations within the well. Downhole well tools can comprise packers, sliding sleeves, valves, chemical injection ports, actuators, gravel packing devices, perforating guns, removable plugs, and other mechanisms having moving parts. Well tools typically require multiple transmission lines or cables to provide control signals and electrical or hydraulic power. Control signals are transmitted from the well surface to change the well tool operating function. Electrical or hydraulic power is transmitted from the well surface to provide sufficient force to move well tool components.

Multiple transmission lines and conduits typically communicate power and signals from the well surface to downhole well tools. Insulated electric cables known as I-wires transmit electricity through one or more conductors, and an electrical ground is provided through another conductor, an outer metallic sheath, or through well casing or tubing. Insulation material is wrapped or extruded between the conductors and metallic sheath to prevent electrical shorts and to furnish rigidity and strength to the cable. Such electric cables can transmit electric control signals to the well tools and can transmit electric power sufficient to operate downhole well tools. However, conventional electric cables are destroyed if salt water or other corrosive well fluids infiltrate the cable outer sheath. Microfissures or small holes can penetrate the outer sheath during cable installation or during the performance of well operations. Downhole well fluid pressures can force the corrosive fluids into the cable interior, thereby leading to conductor failure and mandatory repair operations.

To avoid cable damage, the thickness of the outer cable sheath is often increased. This technique increases the cable material cost and increases the overall cable diameter. Another technique injects epoxy into internal voids between the electrical conductor and the interior surface of the outer metallic sheath. The cured epoxy resists buckling of the cable and adds rigidity to the cable, however the epoxy is relatively brittle and is susceptible to cracking. Forces sufficient to damage the outer cable sheath can also crack the epoxy filler, thereby leading to infiltration by corrosive well fluids.

In addition to the electrical power transmitted through conductor cables, hydraulic lines comprising fluid filled conduits typically provide hydraulic fluid pressure from the well surface to downhole well tools. Conventional hydraulic lines operate safety valves, sliding sleeves, fluid control valves, packers and other well tools. Hydraulic lines provide large forces required for the operation of certain well tools and provide a high degree of system reliability. Depending on the downhole tool design, such tools function when the hydraulic fluid pressure is increased to a selected level, or when the fluid pressure decreases below a selected level.

In addition to electrical conductors and hydraulic conduits, other signal communication systems have been developed. For example, fluid based pulse systems transmit pressure pulses through well tubing fluids or through fluids in the annulus between well tubing and casing pipe. A downhole microprocessor detects the pressure pulses and compares the pulse signature to stored patterns corresponding to command sequences. Such systems communicate control signals through the signature of the pressure pulses, but do not provide power for operating downhole well tools. Accordingly, an alternative source of power must cooperate with the fluid pulse components.

Typical well tool installations require both hydraulic lines and electric lines to provide functional well tool control and operating power. Such installations use at least two lines, hydraulic and electrical, between the well surface and the downhole well tools. These multiple lines are typically attached to the exterior surface of production well tubing and may extend for thousands of meters within the wellbore and wellbore branches. Multiple lines require multiple connecting ends which are subject to failure. Additionally, multiple lines occupy space within the well and reduce the space available for other well components.

A need exists for an improved transmission system for communicating signals and power between the well surface and downhole well tools. The system should resist failure and should provide sufficient flexibility to address changing control and power requirements.

SUMMARY OF THE INVENTION

The present invention provides an improved apparatus and method for communicating electricity to a downhole well tool. The invention comprises a hollow sheath having a first end proximate to the well surface and having a second end extending downwardly to the well tool, an electrical conductor within the sheath for communicating electricity to the tool, and a fluid within the hollow sheath. The fluid can provide insulation to the conductor, can prevent the intrusion of well fluids into the sheath interior, and can be pressurized to provide rigidity to the apparatus.

In other embodiments of the invention, an insulator can be positioned between the conductor and the sheath, and a hollow passage can extend through the insulator. The passage can comprise any material or configuration sufficient to permit the transmission of fluid pressure to the downhole tool. A fluid pressure source can pressurize the fluid to a selected pressure, and a diverter can be positioned between the sheath and the tool to divert electricity or fluid pressure to selected portions of the well tool, or to another tool located within the well.

The method of the invention is practiced by attaching an electrical conductor first end to an electricity source, wherein the conductor extends through an elongated hollow sheath having first and second ends. The conductor second end is attached to the well tool, fluid is placed within the hollow sheath, and electricity is communicated through the conductor. In other embodiments of the invention, an insulator can be placed between the conductor and the sheath, the fluid can be pressurized to communicate fluid pressure downhole to the well tool, and an electrical or hydraulic diverter can switch electricity or divert fluid pressure to a selected portion of the well tool or to a second well tool.

DESCRIPTION OF THE PREFERRED EMBODIMENTS

Figure 1:
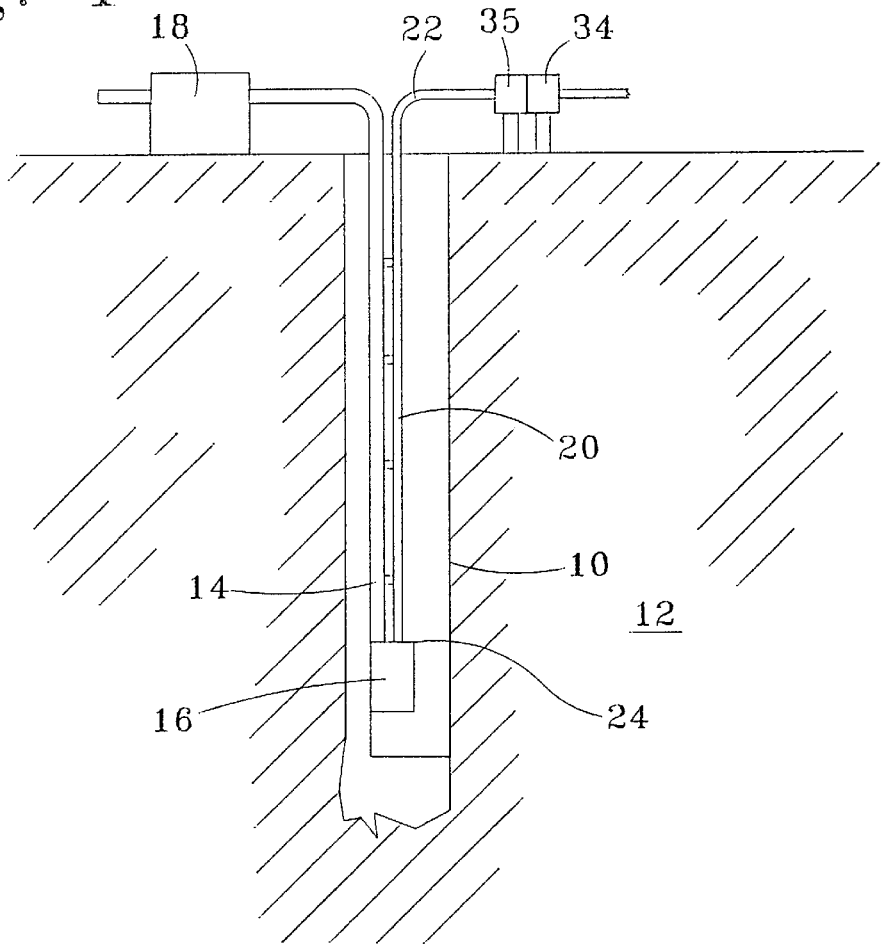
FIG. 1 is an elevation view of the invention installed in a wellbore.

The invention provides a multifunctional apparatus and method for communicating signals and power between a downhole well tool and the well surface. Referring to FIG. 1, an elevation view is shown wherein well or borehole 10 penetrates subsurface geologic formations 12. Production tubing 14 is installed within borehole 10 and is engaged with downhole well tool 16. Well tool 16 can comprise a valve, sliding sleeve, packer, or other apparatus used in the completion of wells, chemical treatment of geologic formations 12 and well equipment, or production of hydrocarbons and other fluids. Production tubing 14 is attached to conventional equipment 18 located at the well surface.

Control and power cable or line 20 provides electricity between the equipment 18 and well tool 16. Line 20 has a first end 22 located at the well surface and has a second end 24 attached to well tool 16. Line 20 can be positioned within production tubing 14 or within the annulus between production tubing 14 and the interior wall of borehole 10. In one embodiment of the invention, line 20 can be attached to the exterior surface of production tubing 14 to stabilize and to centralize line 20 within borehole 10.

Figure 2:
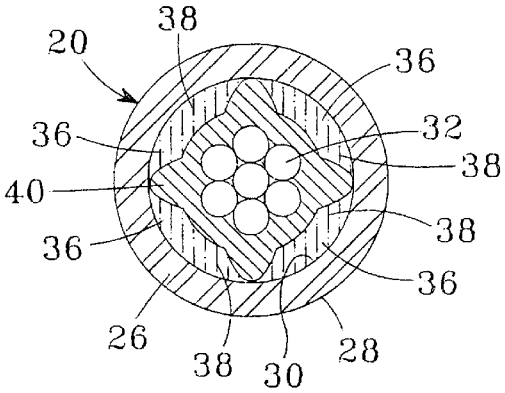
FIG. 2 is a cross-sectional view of one embodiment of the invention.

FIG. 2 illustrates a cross-sectional view for one embodiment of the invention. Hollow sheath 26 defines the exterior surface of line 20 and is formed with a metallic or nonmetallic material. For example, sheath 26 can be formed with steel or other metallic material continuously coiled, welded, drawn or extruded to form the desired shape and configuration. In a preferred embodiment of the invention, sheath 26 is shaped as a thin walled tubular member having cylindrical exterior surface 28 and cylindrical interior wall 30. Sheath 26 is preferably resistant to corrosion, to abrasion damage, and to impact damage.

Electrical conductor 32 is contained within sheath 26 and extends between electricity source 34 and well tool 16. A fluid pressure source such as pump 35 can be engaged with sheath 26 as described below. Conductor 32 can comprise a single strand or can comprise a multi-strand electricity conductor as shown in FIG. 2. Conductor 32 can be formed with copper, aluminum, or other material known for electricity conductivity and low resistance properties.

One or more passages 36 can form a hollow within sheath 26 and provide a continuous path between line first end 22 and line second end 24. Fluid 38 is placed within passage 36 and insulates conductor 32 by resisting electrical conductance between conductor 32 and sheath 36 and by providing heat transfer properties. As used herein, the term "fluid" can comprise hydraulic fluid, liquids, grease, and other media capable of transferring pressure between line first end 22 and line second end 24. Passage 36, identified generally as a fluid pressure transmission passage, can define a single channel, multiple channels, or can be formed with a semi-solid or porous material which permits the physical migration of hydraulic fluid 38 or the transfer of hydraulic fluid 38 pressure. For example, passage 36 can be formed through a powdered or sintered material which fills void space between conductor 32 and sheath interior wall 30, but which permits the migration of hydraulic fluid 38 therethrough.

Hydraulic fluid 38 provides numerous functions with sheath 26, such as thermal and electric insulation for conductor 32. Hydraulic fluid 38 can provide dielectric properties to electrically insulate conductor 32. In another inventive embodiment, hydraulic fluid 38 can thermally insulate conductor 32 by being pumped through sheath 26 to resist heat transfer from well fluids within borehole 10 to conductor 32. Alternatively, hydraulic fluid 38 can promote heat transfer from conductor 32 as excess heat is dissipated into hydraulic fluid 38 or geologic formations 12.

Hydraulic fluid 38 uniquely shields conductor 32 from failure caused by intrusive well fluids. If a microfissure or hole should occur in sheath 26, hydraulic fluid 38 prevents fluids within borehole 10 from intruding into sheath 26 and into contact with conductor 32. The hydrostatic weight of hydraulic fluid 38 within sheath 26 can pressurize hydraulic fluid 38 to a pressure equal to or greater than the pressure of fluids within borehole 10, thereby resisting intrusion of well fluids into sheath 26. This function can be enhanced in preferred embodiments of the invention by furnishing a material for hydraulic fluid 38 having a greater density than the fluids within borehole 10 or other external fluids, or by pressurizing hydraulic fluid 38 with fluid pressure source 35. If a leak should develop within sheath 26, hydraulic fluid 38 can escape through the leak path and into borehole 10, and additional hydraulic fluid 38 can be added within sheath 26 from the well surface. In this fashion, minor leaks within sheath 26 can be detected from the well surface and can be compensated for from the well surface without pulling sheath 26 from borehole 10. Additionally, the magnitude or severity of the leak can be detected by monitoring the hydraulic fluid 38 makeup quantity added to the interior of sheath 26.

When pump 35 pressurizes hydraulic fluid 38, such pressurized fluid cooperates with sheath 26 to increase the overall rigidity and strength of the cable system. The possibility of compressive failure is reduced, and sheath 26 is less likely to buckle. In this fashion, hydraulic fluid 38 and sheath 26 combine to provide a unique cable system that resists mechanical, structural and corrosion failures.

In a preferred embodiment of the invention, a solid or semi-solid insulator such as insulator 40 is positioned between conductor 32 and sheath interior wall 30. Insulator 40 centers conductor 32 within the volume defined by the interior of sheath 26 and provides supplemental internal strength to resist exterior forces acting against sheath 26. Insulator 40 can be configured as a series of ridges, unconnected spacer rings, a spiral, a reverse spiral or other pattern, or can be extruded or otherwise formed to substantially extend along the entire length of conductor 32. Insulator 32 can be formed with different materials and is preferably formed from a material having low electrical conductivity. As shown in FIG. 2, the cross-sectional profile of insulator 40 can be irregular to provide selective contact with sheath interior surface 30 while defining the interior volume perimeters of passages 36.

Figure 3:
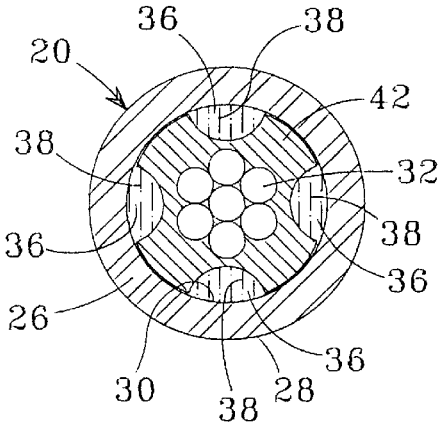
FIG. 3 shows a cross-sectional view of an alternative embodiment of the invention.

FIG. 3 illustrates an alternative configuration of the invention wherein insulator 42 is positioned between conductor 32 and sheath interior wall 30. The flow area within the embodiment in FIG. 3 is approximately 25% of the interior space, and the flow area within the embodiment in FIG. 2 is 75% of the interior space. Insulators 40 and 42 not only provide electrical insulation and impact resistance to line 20, but can also be configurated to resist relative movement between conductor 32 and sheath interior wall 30. This feature of the invention reduces differential movement due to thermal differences and reduces relative movement as line 20 is handled, thereby minimizing internal fatigue stresses and buckling of line 20. The surface area quantity and relative preload force between insulators 40 and 42 and sheath interior wall 30 will determine the relative gripping forces exerted by such contact.

Figure 4:
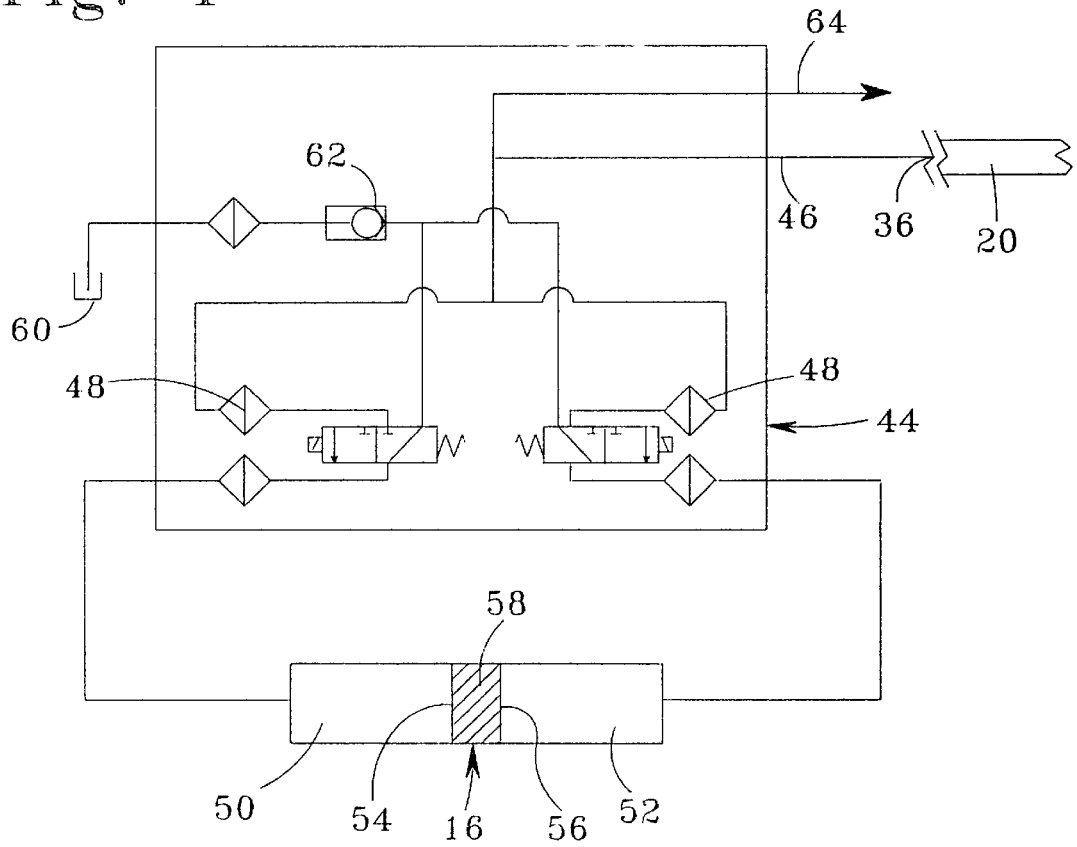
FIG. 4 shows a schematic view of a control circuit between the control line and a well tool.

As shown in FIG. 4, diverter 44 can be placed between line 20 and well tool 16. FIG. 4 illustrates a schematic view of a hydraulic diverter 44 wherein hydraulic input 46 is engaged with passage 36 so that the fluid pressure within passage 36 is communicated to input 46. Hydraulic switches 48 selectively divert the pressure of hydraulic fluid 38 into first chamber 50 or second chamber 52, which respectively contact first surface 54 and second surface 56 of actuator or piston 58. Hydraulic switches 48 can respond to the hydraulic fluid pressure of hydraulic fluid 38 and increase or decrease the pressure within first chamber 50 or second chamber 52 to create or to modify the pressure differential acting across piston 58. Such pressure differential will move piston 58, thereby operating well tool 16.

Although FIG. 4 shows a double acting piston 58 wherein positive hydraulic fluid pressure can drive piston 58 in opposite directions, actuator or piston 58 can be configured in many different ways suitable for accomplishing movement of a tool element in response to hydraulic fluid 38 pressure or electricity provided through conductor 32. For example, discharge port 60 can be provided to permit the discharge of hydraulic fluid 38 away from diverter 44. This feature permits hydraulic fluid 38 to be pumped through passage 36. Check valve 62 maintains fluid pressure within diverter 44 and prevents undesired entry of other fluids into diverter 44. Discharge port 60 can direct hydraulic fluid 38 to the interior or exterior of tubing 14 or to another conduit for further use as described below.

FIG. 4 illustrates the application of diverter 44 to a hydraulic circuit engaged with hydraulic fluid 38 in passage 36, however a functionally comparable circuit could be designed for an electrical switch or diverter to selectively direct electricity from conductor 32 to selected portions of well tool 16 or to other well tools in borehole 10 as described below.

Figure 5:
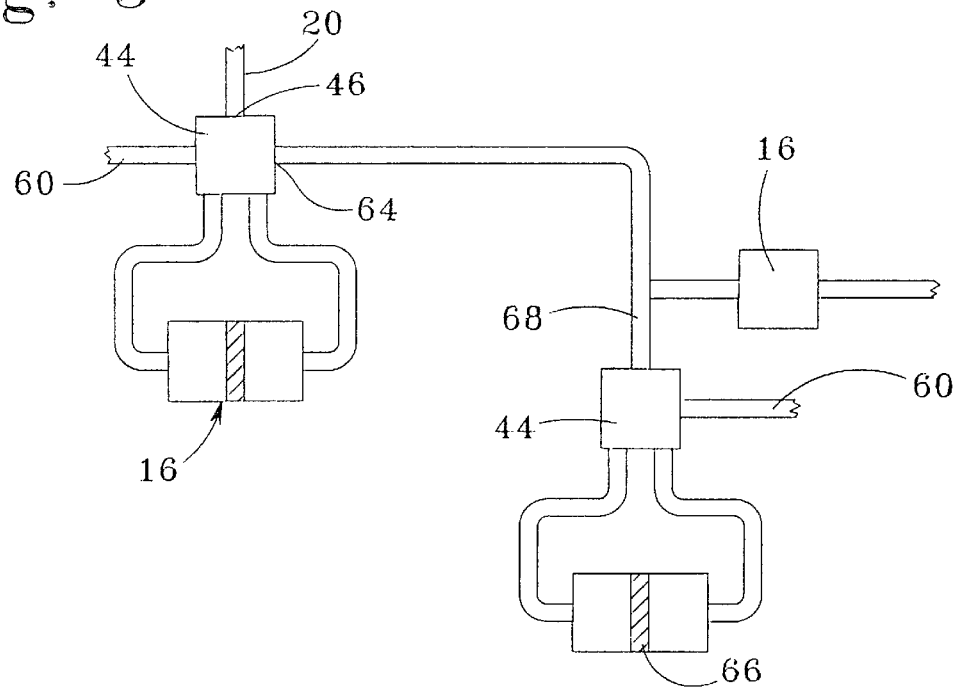
FIG. 5 shows the invention in combination with multiple downhole well tools.

As shown in FIG. 4, the invention is operable from a single line 20 engaged with well tool 16 through hydraulic input 46. Hydraulic output 64 permits parallel operation of additional well tools 16 as shown in FIG. 5. Well tool 66 is engaged with conduit 68 attached to hydraulic output 64. Well tool 66 can have the same operable components as described for the hydraulic circuit in FIG. 4, or can have other configurations. For example, well tool 66 can operate from the full hydraulic fluid 38 pressure delivered to hydraulic input 46, or can reduce such pressure to a lower operating pressure.

The method of the invention is practiced by attaching a first end of an electrical conductor to an electricity source, by attaching a second conductor end to the well tool, by attaching a second sheath end to the well tool, by placing fluid within the sheath, and by communicating electricity through the conductor. An insulator can be installed between the conductor and the sheath to resist movement therebetween, and the hydraulic fluid can be pressurized to a sufficient amount to resist inelastic deformation of the outer sheath or to prevent intrusion of well fluids into the sheath interior. A diverter or switch can be installed between the conductor second end, the sheath second end, and the well tool, and the diverter or switch can be operated to selectively direct electricity or hydraulic fluid to selected well tool portions or to another well tool.

The present invention provides a unique combination of an apparatus and method for communicating electricity between a downhole well tool and the well surface, or between different locations downhole in the well. The hydraulic fluid provides an electrical or thermally insulating medium for the electrical conductor, and also provides a mechanism for dissipating heat from the conductor. The hydraulic fluid can be pressurized to resist collapse of the outer sheath, thereby providing a combined physical structure having a strength substantially greater than the individual component strength. The invention further permits a single line to be installed in the well, thereby reducing the volume requirements for the control and power lines, and reducing the number of joints and connections subject to potential failures. Further, the invention permits the design and construction of unique tool designs which maximize the composite benefits of electrical signal control and large forces provided by hydraulic power sources.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An apparatus for communicating electricity downhole to a well tool in a wellbore, comprising:

a hollow sheath having a first end proximate to the well surface and having a second end extending downwardly to the tool, wherein said sheath has an exterior surface proximate to the wellbore;

an electrical conductor within said hollow sheath for communicating electricity to the tool; and a fluid within said hollow sheath.

2. An apparatus as recited in claim 1, further comprising an insulator between said electrical conductor and said sheath.

3. An apparatus as recited in claim 2, further comprising a passage through said insulator for holding said fluid.

4. An apparatus as recited in claim 1, wherein a liquid is present in the wellbore in contact with said sheath, and wherein said fluid has a density greater than the wellbore liquid.

5. An apparatus as recited in claim 1, wherein said fluid is in contact with a fluid pressure source for pressurizing said fluid within said hollow sheath to a selected pressure.

6. An apparatus as recited in claim 5, further comprising a hydraulic switch responsive to said fluid pressure for selectively diverting said fluid pressure to a selected portion of the tool.

7. An apparatus as recited in claim 6, wherein said hydraulic switch is capable of selectively diverting said fluid pressure into engagement with a second tool in the wellbore.

8. An apparatus as recited in claim 6, wherein said hydraulic switch is capable of selectively diverting said fluid pressure into engagement with a second hydraulic switch in the wellbore.

9. An apparatus as recited in claim 6, further comprising an exit port in fluid communication with said hydraulic switch for discharging hydraulic fluid outside of said passage.

10. An apparatus for communicating electricity and fluid pressure to a downhole well tool from an electric power source and from a fluid pressure source, comprising:

an elongated sheath having a first end proximate to the well surface and having a second end extending downwardly to the tool;

an electrical conductor engaged with the electric power source and extending through said sheath for communicating electricity to the tool; and a fluid pressure transmission passage within said sheath, wherein said passage has a first end engaged with the fluid pressure source, and wherein said passage has a second end engaged with the tool for communicating fluid pressure variations to the tool.

11. An apparatus as recited in claim 10, further comprising a hydraulic diverter engaged with said fluid for selectively diverting the fluid pressure to a selected portion of the tool.

12. An apparatus as recited in claim 10, wherein said sheath provides an electrical ground for electricity transmitted through said conductor.

13. An apparatus as recited in claim 10, further comprising an insulator within said sheath for providing electrical insulation between said conductor and said sheath.

14. A method for communicating electricity to a downhole well tool, comprising the steps of:

attaching an electrical conductor first end to an electricity source, wherein said conductor extends through an elongated hollow sheath having first and second ends;

attaching a second end of said conductor to the well tool;

placing fluid within said hollow sheath for insulating said conductor between the tool and the well surface; and communicating electricity through said conductor to the well tool.

15. A method as recited in claim 14, further comprising the step of installing an insulator between said conductor and said sheath to resist relative movement between said conductor and said sheath.

16. A method as recited in claim 14, further comprising the step of pressurizing said fluid within said hollow sheath to resist inelastic deformation of said sheath.

17. A method as recited in claim 14, further comprising the step of positioning a hydraulic diverter between said conductor second end and the well tool for selectively diverting the fluid pressure to a selected portion of the well tool.

18. A method as recited in claim 17, further comprising the step of positioning an electrical switch between said conductor and the well tool for selectively switching electricity to a selected portion of the well tool.

19. A method as recited in claim 17, further comprising the step of modifying the fluid pressure to operate said diverter.

20. A method as recited in claim 17, further comprising the step of operating said diverter to direct the fluid pressure to a second well tool positioned downhole in the well.

* * * * *